US008946998B2

(12) United States Patent
Edwards et al.

(10) Patent No.: US 8,946,998 B2
(45) Date of Patent: Feb. 3, 2015

(54) LED-BASED LIGHT EMITTING SYSTEMS AND DEVICES WITH COLOR COMPENSATION

(75) Inventors: Charles Owen Edwards, Pleasanton, CA (US); Gang Wang, Milpitas, CA (US); Yi-Qun Li, Danville, CA (US)

(73) Assignee: Intematix Corporation, Fremont, CA (US)

( * ) Notice: Subject to any disclaimer, the term of this patent is extended or adjusted under 35 U.S.C. 154(b) by 0 days.

(21) Appl. No.: 13/204,464

(22) Filed: Aug. 5, 2011

(65) Prior Publication Data

US 2012/0032600 A1 Feb. 9, 2012

Related U.S. Application Data

(60) Provisional application No. 61/372,011, filed on Aug. 9, 2010.

(51) Int. Cl.
*H05B 37/02* (2006.01)
*H05B 33/08* (2006.01)

(52) U.S. Cl.
CPC ..... *H05B 33/0869* (2013.01)
USPC ..... 315/151

(58) Field of Classification Search
USPC ..... 315/151–152, 149–150, 153–155, 246, 315/291, 307, 312
See application file for complete search history.

(56) References Cited

U.S. PATENT DOCUMENTS 3,290,255 A 12/1966 Smith
3,593,055 A 7/1971 Geusic et al.
3,670,193 A 6/1972 Thorington et al.
3,676,668 A 7/1972 Collins et al.
3,691,482 A 9/1972 Pinnow et al.
(Continued)

FOREIGN PATENT DOCUMENTS

CN 101253442 8/2008
CN 101611259 12/2009
(Continued)

OTHER PUBLICATIONS

International Search Report and Written Opinion dated Dec. 13, 2011 for International Application No. PCT/US2011/0046964, 6 pages.
(Continued)

*Primary Examiner* — Minh D A
(74) *Attorney, Agent, or Firm* — Vista IP Law Group, LLP

(57) ABSTRACT

A light emitting system comprises an LED-based light emitting device and a controller for controlling operation of the device. The device comprises at least two LEDs that are operable to generate light of different colors that contribute to the emission product of the device. The controller is operable to control light emission from the LEDs in response to the measured intensity of the first and second color light contributions in the emission product. To measure the individual light contributions the controller is operable to interrupt, or at least change, light emission from one LED for a selected time period and during this time period to measure the intensity of the emission product of the device. The intensity of light of the first and second color can be determined by comparing the measured intensity with the measured intensity when the light emission from the other LED is interrupted or changed.

20 Claims, 2 Drawing Sheets

(56) References Cited

U.S. PATENT DOCUMENTS

| | | | | |
|---|---|---|---|---|
| 3,709,685 | A | 1/1973 | Hercock et al. | |
| 3,743,833 | A | 7/1973 | Martie et al. | |
| 3,763,405 | A | 10/1973 | Mitsuhata | |
| 3,793,046 | A | 2/1974 | Wanmaker et al. | |
| 3,819,973 | A | 6/1974 | Hosford | |
| 3,819,974 | A | 6/1974 | Stevenson et al. | |
| 3,849,707 | A | 11/1974 | Braslau et al. | |
| 3,875,456 | A | 4/1975 | Kana et al. | |
| 3,932,881 | A | 1/1976 | Mita et al. | |
| 3,937,998 | A | 2/1976 | Verstegen et al. | |
| 3,972,717 | A | 8/1976 | Wiedemann | |
| 4,047,075 | A | 9/1977 | Schoberl | |
| 4,075,532 | A | 2/1978 | Piper et al. | |
| 4,081,764 | A | 3/1978 | Christmann et al. | |
| 4,104,076 | A | 8/1978 | Pons | |
| 4,143,394 | A | 3/1979 | Schoeberl | |
| 4,176,294 | A | 11/1979 | Thornton, Jr. | |
| 4,176,299 | A | 11/1979 | Thornton | |
| 4,211,955 | A | 7/1980 | Ray | |
| 4,305,019 | A | 12/1981 | Graff et al. | |
| 4,315,192 | A | 2/1982 | Skwirut et al. | |
| 4,443,532 | A | 4/1984 | Joy et al. | |
| 4,559,470 | A | 12/1985 | Murakami et al. | |
| 4,573,766 | A | 3/1986 | Bournay, Jr. et al. | |
| 4,618,555 | A | 10/1986 | Suzuki et al. | |
| 4,638,214 | A | 1/1987 | Beers et al. | |
| 4,667,036 | A | 5/1987 | Iden et al. | |
| 4,678,285 | A | 7/1987 | Ohta et al. | |
| 4,727,003 | A | 2/1988 | Ohseto et al. | |
| 4,772,885 | A | 9/1988 | Uehara et al. | |
| 4,845,223 | A | 7/1989 | Seybold et al. | |
| 4,859,539 | A | 8/1989 | Tomko et al. | |
| 4,915,478 | A | 4/1990 | Lenko et al. | |
| 4,918,497 | A | 4/1990 | Edmond | |
| 4,946,621 | A | 8/1990 | Fouassier et al. | |
| 4,992,704 | A | 2/1991 | Stinson | |
| 5,077,161 | A | 12/1991 | Law | |
| 5,110,931 | A | 5/1992 | Dietz et al. | |
| 5,126,214 | A | 6/1992 | Tokailin et al. | |
| 5,131,916 | A | 7/1992 | Eichenauer et al. | |
| 5,143,433 | A | 9/1992 | Farrell | |
| 5,143,438 | A | 9/1992 | Giddens et al. | |
| 5,166,761 | A | 11/1992 | Olson et al. | |
| 5,208,462 | A | 5/1993 | O'Connor et al. | |
| 5,210,051 | A | 5/1993 | Carter, Jr. | |
| 5,211,467 | A | 5/1993 | Seder | |
| 5,237,182 | A | 8/1993 | Kitagawa et al. | |
| 5,264,034 | A | 11/1993 | Dietz et al. | |
| 5,283,425 | A | 2/1994 | Imamura | |
| 5,369,289 | A | 11/1994 | Tamaki et al. | |
| 5,405,709 | A | 4/1995 | Littman et al. | |
| 5,439,971 | A | 8/1995 | Hyche | |
| 5,518,808 | A | 5/1996 | Bruno et al. | |
| 5,535,230 | A | 7/1996 | Abe | |
| 5,557,168 | A | 9/1996 | Nakajima et al. | |
| 5,563,621 | A | 10/1996 | Silsby | |
| 5,578,839 | A | 11/1996 | Nakamura et al. | |
| 5,583,349 | A | 12/1996 | Norman et al. | |
| 5,585,640 | A | 12/1996 | Huston et al. | |
| 5,619,356 | A | 4/1997 | Kozo et al. | |
| 5,660,461 | A | 8/1997 | Ignatius et al. | |
| 5,677,417 | A | 10/1997 | Muellen et al. | |
| 5,679,152 | A | 10/1997 | Tischler et al. | |
| 5,763,901 | A | 6/1998 | Komoto et al. | |
| 5,770,887 | A | 6/1998 | Tadatomo et al. | |
| 5,771,039 | A | 6/1998 | Ditzik | |
| 5,777,350 | A | 7/1998 | Nakamura et al. | |
| 5,869,199 | A | 2/1999 | Kido | |
| 5,959,316 | A | 9/1999 | Lowery | |
| 5,962,971 | A | 10/1999 | Chen | |
| 5,998,925 | A | 12/1999 | Shimizu et al. | |
| 6,137,217 | A | 10/2000 | Pappalardo et al. | |
| 6,161,910 | A | 12/2000 | Reisenauer et al. | |
| 6,340,824 | B1 | 1/2002 | Komoto et al. | |
| 6,441,558 | B1 * | 8/2002 | Muthu et al. | 315/149 |
| 6,504,301 | B1 | 1/2003 | Lowery | |
| 6,513,949 | B1 | 2/2003 | Marshall | |
| 6,576,488 | B2 | 6/2003 | Collins et al. | |
| 6,577,073 | B2 | 6/2003 | Shimuzu | |
| 6,600,175 | B1 | 7/2003 | Baretz et al. | |
| 6,636,003 | B2 | 10/2003 | Rahm et al. | |
| 6,642,618 | B2 | 11/2003 | Yagi et al. | |
| 6,642,652 | B2 | 11/2003 | Collins et al. | |
| 6,692,136 | B2 | 2/2004 | Marshall | |
| 6,869,812 | B1 | 3/2005 | Liu | |
| 7,153,015 | B2 | 12/2006 | Brukilacchio | |
| 7,213,940 | B1 | 5/2007 | Van De Ven | |
| 7,311,858 | B2 | 12/2007 | Wang | |
| 7,358,929 | B2 * | 4/2008 | Mueller et al. | 345/1.3 |
| 7,390,437 | B2 | 6/2008 | Dong | |
| 7,479,662 | B2 | 1/2009 | Soules et al. | |
| 7,541,728 | B2 | 6/2009 | Wang | |
| 7,575,697 | B2 | 8/2009 | Li | |
| 7,601,276 | B2 | 10/2009 | Li | |
| 7,615,795 | B2 | 11/2009 | Baretz et al. | |
| 7,648,650 | B2 | 1/2010 | Liu | |
| 7,655,156 | B2 | 2/2010 | Cheng | |
| 7,703,943 | B2 | 4/2010 | Li et al. | |
| 7,943,945 | B2 | 5/2011 | Baretz et al. | |
| 8,159,155 | B2 * | 4/2012 | Deurenberg et al. | 315/360 |
| 2002/0130786 | A1 | 9/2002 | Weindorf | |
| 2003/0076056 | A1 | 4/2003 | Schuurmans | |
| 2004/0016938 | A1 | 1/2004 | Baretz et al. | |
| 2004/0239243 | A1 | 12/2004 | Roberts et al. | |
| 2005/0093792 | A1 | 5/2005 | Yamamoto et al. | |
| 2006/0038511 | A1 * | 2/2006 | Tagawa | 315/291 |
| 2006/0049416 | A1 | 3/2006 | Baretz et al. | |
| 2006/0103612 | A1 | 5/2006 | Ozaki | |
| 2006/0109137 | A1 | 5/2006 | Callahan | |
| 2006/0158090 | A1 | 7/2006 | Wang et al. | |
| 2006/0158881 | A1 | 7/2006 | Dowling | |
| 2007/0047262 | A1 | 3/2007 | Schardt et al. | |
| 2007/0139920 | A1 | 6/2007 | Van De Ven et al. | |
| 2007/0171159 | A1 | 7/2007 | Lee | |
| 2007/0216704 | A1 * | 9/2007 | Roberts et al. | 345/597 |
| 2007/0236627 | A1 | 10/2007 | Ha et al. | |
| 2007/0236628 | A1 | 10/2007 | Epstein | |
| 2008/0068859 | A1 | 3/2008 | Ng et al. | |
| 2008/0088244 | A1 * | 4/2008 | Morishita | 315/154 |
| 2008/0103714 | A1 | 5/2008 | Aldrich et al. | |
| 2008/0111472 | A1 | 5/2008 | Liu et al. | |
| 2008/0136313 | A1 | 6/2008 | Van De Ven et al. | |
| 2008/0217512 | A1 | 9/2008 | Schultz | |
| 2008/0224597 | A1 | 9/2008 | Baretz et al. | |
| 2008/0224598 | A1 | 9/2008 | Baretz et al. | |
| 2008/0238340 | A1 | 10/2008 | Leung et al. | |
| 2008/0246419 | A1 | 10/2008 | Deurenberg | |
| 2009/0001399 | A1 | 1/2009 | Diana et al. | |
| 2009/0091265 | A1 | 4/2009 | Song et al. | |
| 2009/0184616 | A1 | 7/2009 | Van De Ven et al. | |
| 2009/0273918 | A1 | 11/2009 | Falicoff et al. | |
| 2009/0283721 | A1 | 11/2009 | Liu et al. | |
| 2009/0294780 | A1 | 12/2009 | Chou et al. | |
| 2010/0002440 | A1 | 1/2010 | Negley et al. | |
| 2010/0079059 | A1 | 4/2010 | Roberts et al. | |
| 2010/0127283 | A1 * | 5/2010 | van de Ven et al. | 257/89 |
| 2010/0140633 | A1 | 6/2010 | Emerson | |
| 2010/0308712 | A1 | 12/2010 | Li et al. | |
| 2011/0042554 | A1 | 2/2011 | Hilgers et al. | |

FOREIGN PATENT DOCUMENTS

| | | |
|---|---|---|
| EP | 647694 | 4/1995 |
| GB | 2 017 409 | 10/1979 |
| JP | S50-79379 | 11/1973 |
| JP | 60170194 | 9/1985 |
| JP | 862-189770 | 8/1987 |
| JP | H01-1794 71 | 7/1989 |
| JP | 01-260707 | 10/1989 |
| JP | H02-91980 | 3/1990 |
| JP | H3-24692 | 3/1991 |
| JP | 4010665 | 1/1992 |
| JP | 4010666 | 1/1992 |
| JP | 04-289691 | 10/1992 |

(56) References Cited

FOREIGN PATENT DOCUMENTS

| | | |
|---|---|---|
| JP | 4-321280 | 11/1992 |
| JP | 05-152609 | 6/1993 |
| JP | 6207170 | 7/1994 |
| JP | 6-267301 | 9/1994 |
| JP | 6283755 | 10/1994 |
| JP | 07-099345 | 4/1995 |
| JP | H07-176794 | 7/1995 |
| JP | 07-235207 | 9/1995 |
| JP | H7-282609 | 10/1995 |
| JP | H08-7614 | 1/1996 |
| JP | 8-250281 | 9/1996 |
| JP | 2900928 | 3/1999 |
| JP | P2003-234513 | 8/2003 |
| JP | P3724490 | 9/2005 |
| JP | P3724498 | 9/2005 |
| JP | 2008-085026 A | 4/2008 |
| TW | 200910654 | 3/2009 |
| WO | WO 9108508 | 6/1991 |

OTHER PUBLICATIONS

International Search Report and Written Opinion dated Oct. 17, 2011 for International PCT Application No. PCT/US11/41264, 18 pages.
International Search Report and Written Opinion dated Jan. 27, 2011 for International PCT Application No. PCT/US10/56893, 15 pages.
International Preliminary Report dated May 31, 2012 for International PCT Application No. PCT/US10/56893, 9 pages.
International Preliminary Report dated Jan. 10, 2013 for International PCT Application No. PCT/US11/41264, 10 pages.
Final Office Action dated Sep. 11, 2013 for U.S. Appl. No. 12/945,641.
Notice of Allowance dated Jan. 17, 2014 for U.S. Appl. No. 12/945,641.
Chinese Office Action dated Dec. 12, 2013 for Chinese Appln. No. 201180030884.X.
Non-Final Office Action dated Apr. 26, 2013 for U.S. Appl. No. 12/945,641.
"Fraunhofer-Gesellschafl: Research News Special1997", http://www.fhg.de/press/md-e/md1997/sondert2.hlm,(accessed on Jul. 23, 1998), Jan. 1997, Publisher: Fraunhofer Institute.
Adachi, C. et al., "Blue light-emitting organic electroluminescent devices", "Appl. Phys. Lett.", Feb. 26, 1990, pp. 799-801, vol. 56, No. 9.
Akasaki, Isamu, et al., "Photoluminescence of Mg-doped p-type GaN and electroluminescence of GaN p-n junction LED", "Journal of Luminescence", Jan.-Feb. 1991, pp. 666-670, vol. 48-49 pt. 2.
Amano, H., et al., "UV and blue electroluminescence from Al/GaN:Mg/GaN LED treated with low-energy electron beam irradiation (LEEBI)", "Institute of Physics: Conference Series", 1990, pp. 725-730, vol. 106, No. 10.
Apr. 14, 2010 Office Action in U.S. Appl. No. 11/264,124.
Apr. 15, 2009 Office Action in U.S. Appl. No. 11/264,124, issued by Abu I Kalam.
Armaroli, N. et al., "Supramolecular Photochemistry and Photophysics.", "J. Am. Chern. Soc.", 1994, pp. 5211-5217, vol. 116.
Aug. 21, 2006 Office Action in U.S. Appl. No. 10/623,198, issued by Thao X. Le.
Aug. 24, 2007 Office Action in U.S. Appl. No. 11/264,124, issued by Thao X. Le.
Aug. 26, 2010 Office Action in U.S. Appl. No. 12/131,118.
Berggren, M. et al., "Light-emitting diodes with variable colours from polymer blends", "Nature", Dec. 1, 1994, pp. 444-446, vol. 372.
Berggren, M., et al., "White light from an electroluminescent diode made from poly[3(4-octylphenyl)-2,2'-bithiophene] and an oxadiazole . . . ", "Journal of Applied Physics", Dec. 1994, pp. 7530-7534, vol. 76, No. 11.
Boonkosum, W. et al., "Novel Flat Panel display made of amorphous SiN:H/SiC:H thin film LED", "Physical Concepts and Materials for Novel Optoelectronic Device Applications II", 1993, pp. 40-51, vol. 1985.
Bradfield, P.L., et al., "Electroluminescence from sulfur impurities in a p-n junction formed in epitaxial silicon", "Appl. Phys. Lett", 07110/1989, pp. 10D-102, vol. 55, No. 2.
Chao, Zhang Jin, et al., "White light emitting glasses", "Journal of Solid State Chemistry", 1991, pp. 17-29, vol. 93.
Comrie, M. , "Full Color LED Added to Lumex's Lineup", "EBN", Jun. 19, 1995, p. 28.
CRC Handbook, 63rd Ed., (1983) p. E-201.
Das, N.C., et al., "Luminescence spectra of ann-channel metal-oxide-semiconductor field-effect transistor at breakdown", 1990, pp. 1152-1153, vol. 56, No. 12.
Dec. 16, 2004 Office Action in U.S. Appl. No. 10/623,198, issued by Thao X. Le.
Dictionary Definition of Phosphor, Oxford English Dictionary Online, Mar. 9, 2012 (Only partial available due to corrupt file as provided on Mar. 22, 2012 in U.S. Appl. No. 12/131,119; Request for Full Reference filed).
El Jouhari, N., et al., "White light generation using fluorescent glasses activated by Ce3+, Tb3+ and Mn2+ ions", "Journal De Physique IV, Colloque C2", Oct. 1992, pp. 257-260, vol. 2.
Feb. 21, 2012 Office Action in U.S. Appl. No. 12/131,118, issued by Abul Kalam.
Feb. 26, 2008 Office Action in U.S. Appl. No. 11/264,124, issued by Abu I Kalam.
Feb. 4, 2005 Office Action in U.S. Appl. No. 10/623,198, issued by Thao X. Le.
Feb. 7, 2007 Office Action in U.S. Appl. No. 11/264,124, issued by Thao X. Le.
Forrest, S. et al. , "Organic emitters promise a new generation of displays", "Laser Focus World", Feb. 1995, pp. 99-107.
Hamada, Y. et al. , "Blue-Light-Emitting Organic Electroluminescent Devices with Oxadiazole Dimer Dyes as an Emitter", "Jpn. J. Appl. Physics", Jun. 1992, pp. 1812-1816, vol. 31.
Hamakawa, Yoshihiro, et al., "Toward a visible light display by amorphous SiC:H alloy system", "Optoelectronics—Devices and Technologies", Dec. 1989, pp. 281-294, vol. 4, No. 2.
Hirano, Masao, et al., "Various performances of fiber-optical temperature sensor utilizing infrared-to-visible conversion phosphor", "Electrochemisty (JP)", Feb. 1987, pp. 158-164, vol. 55, No. 2, Publisher: Electrochemical Society of Japan.
Jang, S., "Effect of Avalanche-Induced Light Emission on the Multiplication Factor in Bipolar Junction Transistors", "Solid-State Electronics", 1991, pp. 1191-1196, vol. 34, No. 11.
Jan. 29, 2007 Office Action in U.S. Appl. No. 10/623,198, issued by Thao X. Le.
Jan. 30, 2006 Office Action in U.S. Appl. No. 11/264,124, issued by Thao X. Le.
Jan. 7, 2011 Office Action in U.S. Appl. No. 12/131,119, issued by Steven Y. Horikoshi.
Jul. 10, 2008 Office Action in U.S. Appl. No. 11/264,124, issued by Abu I Kalam.
Jul. 14, 2005 Notice of Allowance, Notice of Allowability, and Examiner's Statement of Reasons for Allowance in U.S. Appl. No. 10/623,198, issued by Thao X. Le.
Jul. 14, 2011 Office Action in U.S. Appl. No. 12/131,119, issued by Steve Horikoshi.
Jul. 7, 2011 Office Action in U.S. Appl. No. 12/131,118, issued by Abu I Kalam.
Jun. 14, 2006 Office Action in U.S. Appl. No. 11/264,124, issued by Thao X. Le.
Jun. 26, 2007 Office Action in U.S. Appl. No. 10/623,198, issued by Thao X. Le.
Kido, J. et al. , "1,2,4-Triazole Derivative as an Electron Transport Layer in Organic Luminescent Devices", "Jpn. J. Appl. Phys.", Jul. 1, 1993, pp. L917-L920, vol. 32.
Kido, J. et al. , "Bright blue electroluminescence from poly(N-vinylcarbazole)", "Appl. Phys. Letters", Nov. 8, 1993, pp. 2627-2629, vol. 63, No. 19.
Kido, J., et al., "White light-emitting organic electroluminescent devices using the poly(N-vinylcarbazole) emitter layer doped with . . . ", "Appl. Phys. Lett.", Feb. 14, 1994, pp. 815-817, vol. 64, No. 7.

(56) References Cited

OTHER PUBLICATIONS

Krames, M., et al., "Status and Future of High-Power Light-Emitting Diodes for Solid-Slate Lighting", "Journal of Display Technology", Jun. 2007, pp. 160-175, vol. 3, No. 2.
Kudryashov, V., et al., "Spectra of Superbright Blue and Green InGaN/AlGaN/GaN Light-Emitting diodes", "Journal of the European Ceramic Society", May 1996, pp. 2033-2037, vol. 17.
Larach, S., et al., "Blue emitting luminescent phosphors: Review and status", "Int'l Workshop on Electroluminescence", 1990, pp. 137-143.
LEDs and Laser Diodes, Electus Distribution, copyright 2001, available at URL:http://www.jaycar.com.au/images_uploaded/ledlaser.Pdf.
Lester, S., et al., "High dislocation densities in high efficiency GaN-based light-emitting diodes", "Appl. Phys. Lett.", Mar. 6, 1995, pp. 1249-1251, vol. 66, No. 10.
Lumogen® F Violet 570 Data Sheet; available at the BASF Chemical Company website Lumogen® F Violet 570 Data Sheet; available at the BASF Chemical Company website URL,http://worldaccount.basf.com/wa/EUen_GB/Catalog/Pigments/doc4/BASF/PRD/30048274/.pdt?title=Technicai%20Datasheet&asset_type=pds/pdf& language=EN&urn=urn:documentum:eCommerce_soi_EU : 09007bb280021e27.pdf :09007bb280021e27.pdf.
Mar. 2, 2009 Office Action in U.S. Appl. No. 10/623,198, issued by Abu I Kalam.
Mar. 22, 2012 Office Action in U.S. Appl. No. 12/131,119, issued by Steven Y. Horikoshi.
Mar. 28, 2006 Office Action in U.S. Appl. No. 10/623,198, issued by Thao X. Le.
Mar. 4, 2011 Notice of Allowance, Notice of Allowability, Examiner's Interview Summary, Examiner's Amendment/ Comment and Examiner's Statement of Reason for Allowance in U.S. Appl. No. 11/264,124, issued by Abu I Kalam.
Mar. 7, 2008 Office Action in U.S. Appl. No. 10/623,198, issued by Abu I Kalam.
Maruska, H.P., "Gallium nitride light-emitting diodes (dissertation)", "Dissertation Submitted to Stanford University", Nov. 1973.
Maruska, H.P., et al., "Violet luminescence of Mg-doped GaN", "Appl. Phys. Lett.", Mar. 15, 1973, pp. 303-305, vol. 22, No. 6.
May 4, 2010 Office Action in U.S. Appl. No. 12/131,119.
McGraw-Hill, "McGraw-Hill Dictionary of Scientific and Technical Terms, Third Edition", "McGraw-Hill Dictionary of Scientific and Technical Terms", 1984, pp. 912 and 1446, Publisher: McGraw-Hill.
McGraw-Hill, "McGraw-Hill Encyclopedia of Science and Technology, Sixth Edition", "McGraw-Hill Encyclopedia of Science and Technology", 1987, pp. 582 and 60-63, vol. 9-10, Publisher: McGraw-Hill.
Mimura, Hidenori, et al., "Visible electroluminescence from uc-SiC/porous Si/c-Si p-n junctions", "Int. J. Optoelectron.", 1994, pp. 211-215, vol. 9, No. 2.
Miura, Noboru, et al., "Several Blue-Emitting Thin-Film Electroluminescent Devices", "Jpn. J. Appl. Phys.", Jan. 15, 1992, pp. L46-L48, vol. 31, No. Part 2, No. 1A IB.
Morkoc et al., "Large-band-gap SiC, 111-V nitride, and II-VI ZnSe-based semiconductor device technologies", J. Appl. Phys. 76(3), 1; Mar. 17, 1994; Illinois University.
Muench, W.V., et al., "Silicon carbide light-emitting diodes with epitaxial junctions", "Solid-State Electronics", Oct. 1976, pp. 871-874, vol. 19, No. 10.
Mukai, T., et al., "Recent progress of nitride-based light emitting devices", "Phys. Stat. Sol.", Sep. 2003, pp. 52-57, vol. 200, No. 1.
Nakamura, S., et al., "High-power InGaN single-quantum-well-structure blue and violet light-emitting diodes", "Appl. Phys. Lett.", Sep. 25, 1995, pp. 1868-1870, vol. 67, No. 13.
Nakamura, S., et al., "The Blue Laser Diode: GaN Based Light Emitters and Lasers", Mar. 21, 1997, p. 239, Publisher: Springer-Verlag.
Nakamura, S., et al., "The Blue Laser Diode: The Complete Story, 2nd Revised and Enlarged Edition", Oct. 2000, pp. 237-240, Publisher: Springer-Verlag.
Nov. 30, 2010 Office Action in U.S. Appl. No. 12/131,118.
Oct. 20, 2008 Office Action in U.S. Appl. No. 10/623,198, issued by Abu I Kalam.
Pankove, J.I., et al., "Scanning electron microscopy studies of GaN", "Journal of Applied Physics", Apr. 1975, pp. 1647-1652, vol. 46, No. 4.
Pavan, P., et al., "Explanation of Current Crowding Phenomena Induced by Impact Ionization in Advanced Si Bipolar Transistors by Means of . . . ", "Microelectronic Engineering", 1992, pp. 699-702, vol. 19.
Pei, Q, et al., "Polymer Light-Emitting Electrochemical Cells", "Science", Aug. 25, 1995, pp. 1086-1088, vol. 269, No. 5227.
Reexam Advisory Action dated Sep. 28, 2012 for U.S. Appl. No. 90/010,940.
Reexam Final Office Action dated May 24, 2012 for U.S. Appl. No. 90/010,940.
Reexam Final Office Action dated Nov. 7, 2011 for U.S. Appl. No. 90/010,940.
Reexam Non-Final Office Action dated Jan. 26, 2012 for U.S. Appl. No. 90/010,940.
Reexam Non-Final Office Action dated Mar. 3, 2011 for U.S. Appl. No. 90/010,940.
Reexam Non-Final Office Action dated Sep. 20, 2010 for U.S. Appl. No. 90/010,940.
Roman. D., "LEDs Turn a Brighter Blue", "Electronic Buyers' News", Jun. 19, 1995, pp. 28 and 35, vol. 960, Publisher: CMP Media LLC.
Saleh and Teich, Fundamentals of Photonics, New York: John Wiley & Sons, 1991, pp. 592-594.
Sato, Yuichi, et al., "Full-color fluorescent display devices using a near-UV light-emitting diode", "Japanese Journal of Applied Physics", Jul. 1996, pp. L838-L839, vol. 35, No. ?A.
Sep. 17, 2009 Notice of Allowance, Notice of Allowability, Examiner's Amendmeni/Comment, and Examiner's Statement of Reasons for Allowance in U.S. Appl. No. 10/623,198, issued by Abul Kalam.
Sep. 29, 2009 Office Action in U.S. Appl. No. 11/264,124, issued by Abu I Kalam.
Tanaka, Shosaku, et al., "Bright white-light electroluminescence based on nonradiative energy transfer in Ce- and Eu-doped SrS thin films", "Applied Physics Letters", Nov. 23, 1987, pp. 1661-1663, vol. 51, No. 21.
Tanaka, Shosaku, et al., "White Light Emitting Thin-Film Electroluminescent Devices with SrS:Ce,Cl/ZnS:Mn Double Phosphor Layers", "Jpn. J. Appl. Phys.", Mar. 20, 1986, pp. L225-L227, vol. 25, No. 3.
The Penguin Dictionary of Electronics, 3rd edition, pp. 315,437-438, 509-510, copyright 1979, 1988, and 1998.
Ura, M. , "Recent trends of development of silicon monocarbide blue-light emission diodes", "Kinzoku", 1989, pp. 11-15, vol. 59, No. 9.
Werner, K. , "Higher Visibility for LEDs", "IEEE Spectrum", Jul. 1994, pp. 30-39.
Wojciechowski, J. et al. , "Infrared-To-Blue Up-Converting Phosphor", "Electron Technology", 1978, pp. 31-47, vol. 11, No. 3.
Yamaguchi, Y. et al., "High-Brightness SiC Blue LEDs and Their Application to Full Color LED Lamps", "Optoelectronics—Devices and Technologies", Jun. 1992, pp. 57-67, vol. 7, No. 1.
Yang, Y., et al., "Voltage controlled two color light-emitting electrochemical cells", "Appl. Phys. Lett.", 1996, vol. 68, No. 19.
Yoshimi, Masashi, et al., "Amorphous carbon basis blue light electroluminescent device", "Optoelectronics—Devices and Technologies", Jun. 1992, pp. 69-81, vol. 7, No. 1.
Zanoni, E., et al., "Impact ionization, recombination, and visible light emission in ALGaAs/GaAs high electron mobility transistors", "J. Appl. Phys.", 1991, pp. 529-531, vol. 70, No. 1.
Zanoni, E., et al., "Measurements of Avalanche Effects and Light Emission in Advanced Si and SiGe Bipolar Transistors", "Microelectronic Engineering", 1991, pp. 23-26, vol. 15.
Zdanowski, Marek, "Pulse operating up-converting phosphor LED", "Electron Technol.", 1978, pp. 49-61, vol. 11, No. 3.

(56) References Cited

OTHER PUBLICATIONS

Zhiming, Chen, et al., "Amorphous thin film white-LED and its light-emitting mechanism", "Conference Record of the 1991 International Display Research Conference", Oct. 1991, pp. 122-125.

Extended Search Report dated Sep. 24, 2014 for EP Appln. No. 11816884.8.

Chinese Office Action dated Oct. 16, 2014 for Chinese Appln. No. 201180030884.X.

Non-Final Office Action dated Jul. 1, 2014 for U.S. Appl. No. 13/164,535.

Notice of Allowance dated Jun. 20, 2014 for U.S. Appl. No. 12/945,641.

* cited by examiner

LED-BASED LIGHT EMITTING SYSTEMS AND DEVICES WITH COLOR COMPENSATION

CROSS REFERENCE TO RELATED APPLICATION

This application claims the benefit of priority to U.S. Provisional Patent Application No. 61/372,011, filed Aug. 9, 2010, entitled "LED-Based Light Emitting Systems and Devices with Color Compensation" by Charles O. Edwards et al., the specification and drawings of which are incorporated herein by reference.

BACKGROUND OF THE INVENTION

1. Field of the Invention

This invention relates to LED-based (Light Emitting Diode-based) light emitting systems and devices with color compensation.

2. Description of the Related Art

White light emitting LEDs ("white LEDs") are known in the art and are a relatively recent innovation. It was not until LEDs emitting in the blue/ultraviolet part of the electromagnetic spectrum were developed that it became practical to develop white light sources based on LEDs. As taught, for example in U.S. Pat. No. 5,998,925, white LEDs include one or more phosphor materials, that is photo-luminescent materials, which absorb a portion of the radiation emitted by the LED and re-emit radiation of a different color (wavelength). Typically, the LED chip or die generates blue light and the phosphor(s) absorbs a percentage of the blue light and re-emits yellow light or a combination of green and red light, green and yellow light, green and orange or yellow and red light. The portion of the blue light generated by the LED that is not absorbed by the phosphor combined with the light emitted by the phosphor provides light which appears to the human eye as being white in color.

Due to their long operating life expectancy (>50,000 hours) and high luminous efficacy (70 lumens per watt and higher) high brightness white LEDs are increasingly being used to replace conventional fluorescent, compact fluorescent and incandescent light sources.

The ability of a light source to render the color of an object is measured using the Color Rendering Index (CRI) which gives a measure of how a light source makes the color of an object appear to the human eye and how well subtle variations in color shade are revealed. CRI is a relative measurement of the light source's ability to render color compared with a black body radiator. In applications where accurate color rendition is required, such as for example retail lighting, museum lighting and lighting of artwork, a high CRI (typically at least 90) is highly desirable.

A disadvantage of white LEDs can be their relatively low CRI, typically <75, compared with an incandescent source whose CRI is >95. The low CRI is due to the absence of light in the red (>600 nm) part of the spectrum. To improve the CRI of a white LED it is known to incorporate a red emitting LED. U.S. Pat. Nos. 6,513,949 and 6,692,136, both to Marshall et al., teach hybrid white LED lighting systems comprising a combination of one or more LEDs (red or green) and a phosphor-LED consisting of a blue LED and at least one phosphor (green or amber).

U.S. Pat. No. 6,577,073 to Shimizu et al. disclose an LED lamp that includes blue and red LEDs and a phosphor. The blue LED produces an emission falling within a blue wavelength range. The red LED produces an emission falling within a red wavelength range. The phosphor is photo-excited by the emission of the blue LED to exhibit photoluminescence having an emission spectrum in an intermediate wavelength range between the blue and red wavelength ranges.

U.S. Pat. No. 7,213,940 to Van Den Ven et al. disclose a white light emitting device that comprises first and second groups of solid state light emitters (LEDs) which emit light having a dominant wavelength in a range 430 nm to 480 nm (blue) and 600 nm to 630 nm (red) and a phosphor material which emits light with a dominant wavelength in a range 555 nm to 585 nm (yellow).

In lighting applications it is important to have color control to maintain the same CCT (Correlated Color Temperature) over the life of the LED lighting system. Several factors can contribute to a color change in LED-based light emitting devices. These factors include aging of the LED die and/or phosphor, operating temperature and aging of electronic drive components.

Whilst the use of red LEDs combined with blue LEDs and phosphors to create white light has shown advantages for creating high CRI light, high R9 content and high efficiency warm light, one problem with this type of device is that the red LED typically ages faster than the blue LEDs and the device's emission product, most notably CCT and CRI, will change with both operating time and temperature. This effect is called differential aging and it results in a color shift of the light over time. For many lighting applications such a color shift is unacceptable and causes problems such as for example old fixtures no longer matching the light color of new fixtures and lighting that falls out of specification. As represented in FIG. 1*a* the changes in emission intensity of blue and red light emitting LEDs with operating temperature and time are different. Typically the emission intensity of a red LED decreases significantly quicker than a blue LED with increased operating temperature and time. For example over an operating temperature range of 25° C. to 75° C. the emission intensity of a GaN-based blue LED can decrease by about 5% whilst the emission intensity of a AlGaInP-based red LED can decrease by about 40%. In a white light emitting device based on blue and red LEDs these different emission intensity/time and/or emission intensity/temperature characteristics will, as shown in FIG. 1*b*, result in a change in the spectral composition of the emission product and an increase in CCT with increased operating time and temperature. Moreover as shown in FIG. 1*b* a reduction in the relative proportion of red light in the emission product with increasing operating temperature and time will result in a decrease in CRI.

Colorimeters are well understood and it is known to integrate a colorimeter into lighting systems. Such systems typically incorporate three or more photo sensors that are color sensitive (RGB for example). The calibration and accuracy of colorimetric systems can be challenging and expensive. Shifts in performance of the color sensors can introduce color error to the systems so these devices need to be very accurate and well calibrated. For many applications, such as for example general lighting, colorimetric systems are prohibitively expensive.

It is an object of the present invention to provide a light emitting system and/or device that in part at least overcomes the limitations of the known devices.

SUMMARY OF THE INVENTION

Embodiments of the invention are directed to light emitting systems comprising an LED-based light emitting device and a controller for controlling operation of the device. The light emitting device comprises a first LED that is operable to generate light of a first color and a second LED that is operable to generate light of a second color wherein the emission product of the device comprises the combined light of the first and second colors. In accordance with embodiments of the invention the device further comprises a single photosensor that is configured to measure the contribution of light of the first and second colors in the emission product. The controller is operable to control light emission from the LEDs in response to the measured intensity of light of the first and second color in the emission product. The controller is operable to interrupt, or at least change typically reduce, light emission from one LED for a selected time period and during this time period to measure the intensity of the emission product of the device. The intensity of light of the first and second color can be determined by comparing the measured intensity with both LEDs operating with the measured intensity of the device when the light emission from one LED is interrupted or changed. A particular benefit of the invention is that a single photosensor can be used to measure the intensities of light of the first and second colors in the emission product.

Typically the controller is configured to control the LEDs such that the contributions of light of the first and second colors in the emission product remain substantially constant. Such a control system can at least in part reduce changes in the color of the emission product of the device due to differential ageing of the LEDs and/or due to changes in the emission characteristics of the LEDs due to operating temperature. Moreover the invention can be applied to systems comprising LEDs of three or more colors and a single photosensor used to measure the contribution of each color in the emission product by interrupting and/or changing the intensity of one or more of the LEDs.

According to the invention a light emitting system comprises: a light emitting device and a controller for operating the device, wherein the device comprises: a first LED operable to emit light of a first color; a second LED operable to emit light of a second color, wherein the emission product of the device comprises the combination of light emitted by the first and second LEDs; and a single photosensor for measuring the intensities of the first and second color light components in the emission product and wherein the controller operable to control light emission from the LEDs in response to the measured emission intensities of light emitted by the first and second LEDs and wherein the controller is operable to change light emission from one LED for a time period and during said time period to measure the light intensity of light being emitted by the device.

The controller can be operable to interrupt light emission from one LED for a time period and during said time period to measure the light intensity of light being emitted by the other LED. Alternatively the controller can be operable to reduce light emission from one LED for the time period and during the time period to measure the light intensity of light being emitted by the device. To avoid perceptible flickering and/or color modulation of light emitted by the device the time period during which one LED is interrupted or reduced is less than about 30 ms.

To maintain a substantially constant color of light emitted by the system the controller can be operable to maintain a substantially constant ratio of the first to second color light in the emission product. Preferably the controller is operable to maintain the emission product within approximately two MacAdam ellipses of a target emission product color.

The photosensor can comprise a photodiode, a photo resistor, a photo transistor or a photocell. An advantage of the latter, compared with the others, can be that since it generates an electrical current operation is not necessarily reliant on generation of an accurate reference voltage or current. Light emission from the LEDs can be controlled by controlling the magnitude of a drive current and/or drive voltage to the LEDs. In one implementation the LEDs are operable using a pulse width-modulated (PWM) drive signal and light emission is controlled by controlling a duty cycle of the drive PWM signal. An advantage of using a PWM drive signal is that it enables very accurate control of the drive current/voltage.

Where it is required to generate white light the first LED can be operable to emit blue light having a peak wavelength in a wavelength range 440 nm to 480 nm. For high CRI devices the second LED can be operable to emit red light having a peak wavelength in a wavelength range 610 nm to 670 nm. For the generation of white light the light emitting device can further comprise at least one phosphor material that is operable to absorb at least a portion of light emitted by the first LED and in response to emit light of a different color, typically green, green/yellow or yellow, such that the combined light output of the device appears white in color. Typically the phosphor material emits light having a dominant wavelength in a range 500 nm to 600 nm.

BRIEF DESCRIPTION OF THE DRAWINGS

In order that the present invention is better understood a white light emitting device in accordance with the invention will now be described, by way of example only, with reference to the accompanying drawings in which.

DETAILED DESCRIPTION OF THE INVENTION

Figure 1A:
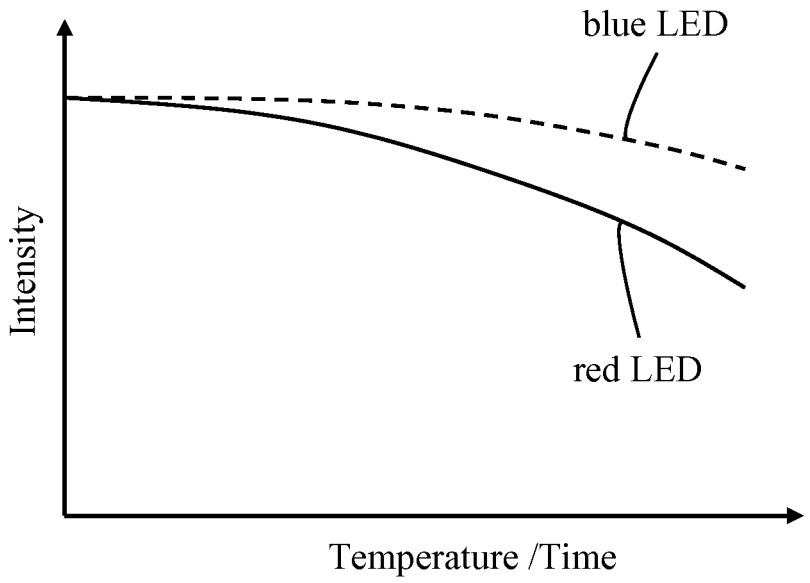
FIG. 1*a* is a plot of emitted light intensity versus operating temperature for blue and red light emitting LEDs as previously described.
Figure 1B:
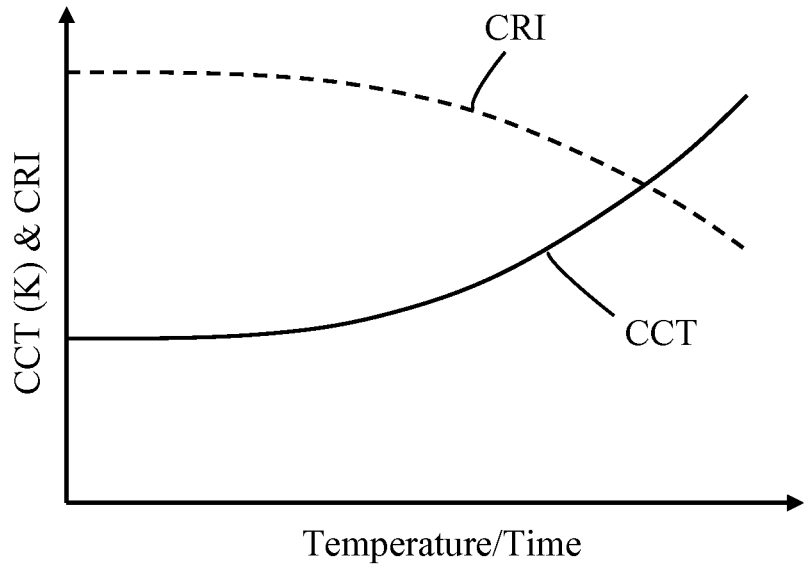
FIG. 1*b* is a plot of CCT and CRI of emitted light versus operating temperature for a known white light emitting device comprising blue and red LEDs as previously described.

Embodiments of the invention are directed to light emitting systems comprising an LED-based light emitting device and a controller for controlling operation of the device. The light emitting device comprises at least two LEDs that are operable to generate light of different colors and in which the emission product of the device comprises the combined light from the LEDs. The device further comprises a single photosensor for measuring the light contributions in the emission product from the LEDs. The controller is operable to control light emission from the LEDs in response to the measured intensity of the first and second color light contributions in the emission product. To measure the individual light contributions the controller is operable to interrupt, or at least change typically reduce, light emission from one LED for a selected time period and during this time period to measure the intensity of the emission product of the device. The intensity of light of the first and second color can be determined by comparing the measured intensity with the measured intensity when the light emission from the other LED is interrupted or changed/reduced.

Throughout this patent specification like reference numerals are used to denote like parts.

Figure 2:
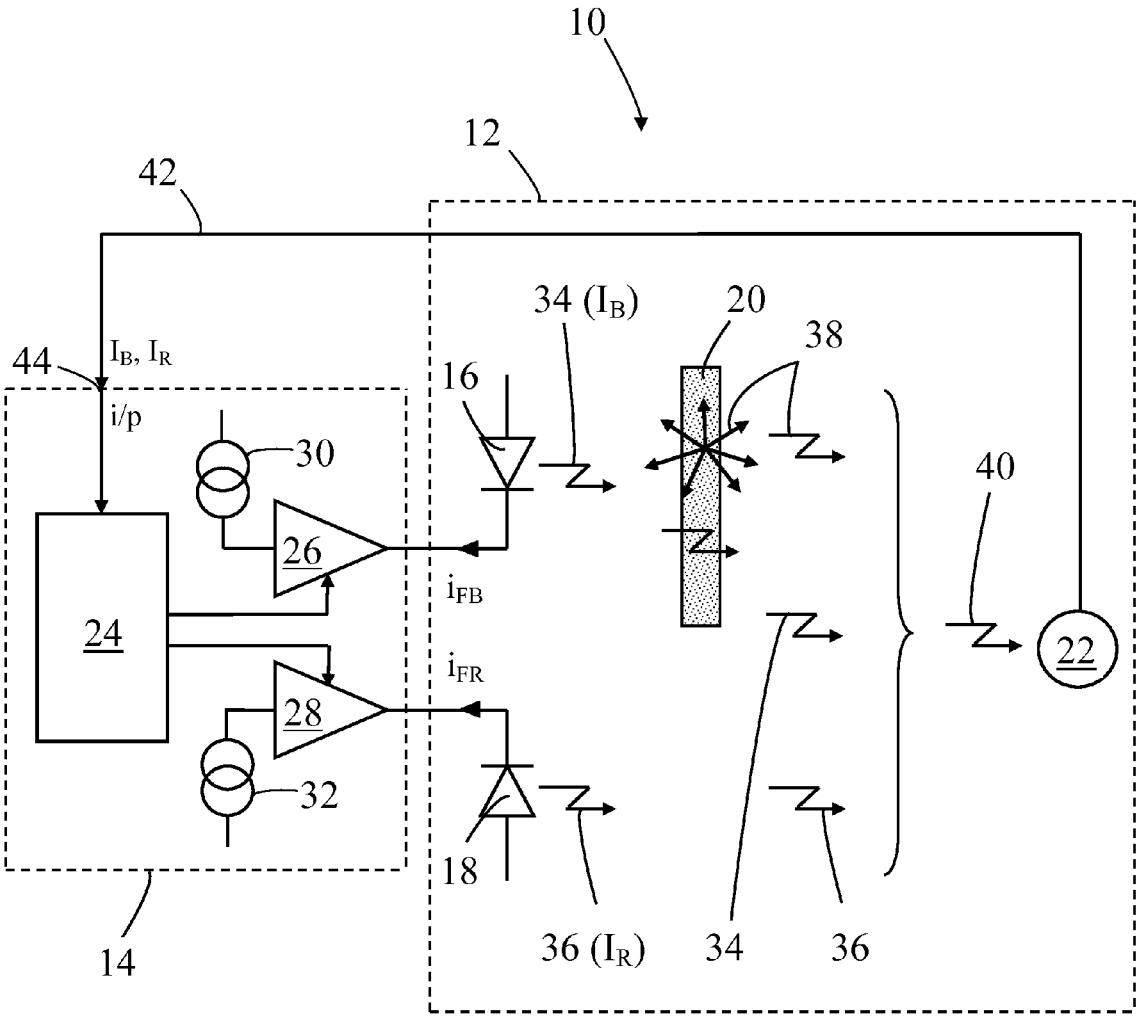
FIG. 2 is a schematic representation of an LED-based light emitting system in accordance with an embodiment of the invention.

Referring to FIG. 2 there is shown a schematic representation of an LED-based white light emitting system 10 in accordance with an embodiment of the invention. The system 10 comprises an LED-based white light emitting device 12 and a driver circuit or "smart" power supply 14 for operating the device 12.

The light emitting device 12 comprises at least one blue light emitting LED 16, at least one red LED 18, at least one blue light excitable phosphor material 20 and a photosensor 22. The driver circuit 14 comprises a controller 24 and a respective PWM (Pulse-Width Modulation) driver 26, 28 for each LED. The controller 24 can comprise a simple microcontroller or processor such as for example an Intel 8051, PIC or ARM processor. The LED drivers 26, 28 can comprise a FET (Field Effect Transistor) for generating a PWM drive current $i_{FB}$, $i_{FR}$ by modulating the current from an associated current source 30, 32. As will be further described the driver circuit 22 is operable to control the forward drive currents $i_{FB}$ and $i_{FR}$ of the blue and red LEDs 16, 18 to compensate for changes in the color of the emission characteristics of the LEDs and/or phosphor material.

In a preferred embodiment the blue LED(s) 16 comprise a GaN-based (gallium nitride-based) LED die that is operable to generate blue light 34 having a peak wavelength in a wavelength range 440 nm to 480 nm (typically 465 nm). The red LED 18 can comprise an AlGaAs (aluminum gallium arsenic), GaAsP (gallium arsenic phosphide), AlGaInP (aluminum gallium indium phosphide) or GaP (gallium phosphide) LED die that is operable to generate red light 36 having a peak wavelength in a wavelength range 610 nm to 670 nm. The blue LED 16 is configured to irradiate the phosphor material 20 with blue light 30 which absorbs a portion of the blue light 34 and in response emits light 38 of a different color, typically yellow-green and having a dominant wavelength in a range 500 nm to 600 nm. The emission product 40 of the device comprises the combined light 34, 36 emitted by the LEDs 16, 18 and the light 38 generated by the phosphor material 20. In one arrangement the LEDs 16, 18, phosphor 20 and photosensor 22 are co-packaged.

The phosphor material 20, which is typically in powder form, is mixed with a transparent binder material such as a polymer material (for example a thermally or UV curable silicone or an epoxy material) and the polymer/phosphor mixture applied to the light emitting face of the blue LED die 16 in the form of one or more layers of uniform thickness. Alternatively the phosphor material can be provided remote to the blue LED 16 such as for example as a layer on, or incorporated within, a light transmissive window. Benefits of providing the phosphor remote to the LED die include reduced thermal degradation of the phosphor and a more consistent color and/or CCT of emitted light since the phosphor is provided over a much greater area as compared to providing the phosphor directly to the light emitting surface of the LED die.

The phosphor material can comprise an inorganic or organic phosphor such as for example a silicate-based phosphor of a general composition $A_3Si(O,D)_5$ or $A_2Si(O,D)_4$ in which Si is silicon, O is oxygen, A comprises strontium (Sr), barium (Ba), magnesium (Mg) or calcium (Ca) and D comprises chlorine (Cl), fluorine (F), nitrogen (N) or sulfur (S). Examples of silicate-based phosphors are disclosed in U.S. Pat. No. 7,575,697, entitled "Europium activated silicate-based green phosphor" (assigned to Intematix Corp.), U.S. Pat. No. 7,601,276, entitled "Two phase silicate-based yellow phosphor" (assigned to Intematix Corp.), U.S. Pat. No. 7,655,156, entitled "Silicate-based orange phosphor" (assigned to Intematix Corp.) and U.S. Pat. No. 7,311,858, entitled "Silicate-based yellow-green phosphor" (assigned to Intematix Corp.). The phosphor can also comprise an aluminate-based material such as is taught in U.S. Pat. No. 7,541,728, entitled "Aluminate-based green phosphor" (assigned to Intematix Corp.) and U.S. Pat. No. 7,390,437, entitled "Aluminate-based blue phosphor" (assigned to Intematix Corp.), an aluminum-silicate phosphor as taught in U.S. Pat. No. 7,648,650, entitled "Aluminum-silicate orange-red phosphor" (assigned to Intematix Corp.) or a nitride-based red phosphor material such as is taught in co-pending U.S. patent application Ser. No. 12/632,550 filed Dec. 7, 2009 (U.S. Publication No. 2010/0308712). It will be appreciated that the phosphor material is not limited to the examples described herein and can comprise any phosphor material including nitride and/or sulfate phosphor materials, oxy-nitrides and oxy-sulfate phosphors or garnet materials (YAG).

As will be further described the photosensor 22 is configured to measure the intensities $I_B$ and $I_R$ of the blue and red light contributions to the emission product 40 of the device. By means of a feedback arrangement 42 the driver circuit 14 in response to the measured intensities $I_B$ and $I_R$ adjusts the forward drive current of the red and/or blue LED to compensate for changes arising in the color of the emission characteristics of the LEDs and/or phosphor material. The photosensor 22 can comprise any photoelectric device that can modify or produce an electrical current and/or voltage whose magnitude is related to the intensity of light incident on the photosensor. In one arrangement the photosensor comprises a phototransistor, such as for example a Darlington NTE3034A NPN phototransistor, connected in series across a reference voltage. The reference voltage is typically provided by the driver circuit 14. Alternatively the photosensor can comprise a photodiode, photoresistor or a photocell. The photosensor, which is typically co-packaged with the LEDs, is configured to receive light from the red and blue LEDs. The intensity of light emitted by the blue and red LEDs will typically be different with the intensity $I_B$ of the blue light being greater than the intensity $I_R$ of the red light. It is envisioned that, by changing the relative placement of the two LEDs to the photosensor, it should be possible to balance the range of photosensor readings for light from the blue and red LEDs. It is preferable to configure the device such that the blue and red LEDs have similar minimum and maximum sensor readings over their range of operation. In the exemplary embodiment the photosensor reading for the blue LED will typically be greater than the red LED and the placement of the photosensor is configured such as to gather a greater proportion of red light and thereby at least in part balance that with the stronger blue light reading. This can be achieved by positioning the photosensor closer to the red LED. It is also envisioned to balance the photosensor readings for the two LEDs using internal optics near the photosensor or the angle of the photosensor relative to the two LEDs. Placement and/or optics to attain balanced photosensor readings is preferred and it is anticipated to provide improved accuracy in color control.

In operation the driver circuit 14, in response to the measured intensities $I_B$, $I_R$, controls the light output from the blue and/or red LEDs by changing the duty cycle of one or both PWM drive currents such as to minimize any change in the ratio $I_B$:$I_R$. The driver circuit 14 can be configured to adjust both forward drive currents $i_{FR}$, $i_{FB}$ such as to minimize any change in the absolute values of the emission intensities $I_R$ and $I_B$. Such a control configuration not only reduces any changes in the color of the emission product 40 but additionally reduces any change in the overall emission intensity from the device. Alternatively the driver circuit is operable to adjust the light output from one LED in order to maintain a substantially constant ratio of $I_B$:$I_R$. It is anticipated that the red LED(s) will reduce in light emission over time faster than the blue LED(s) and consequently the system will typically be required to increase the light output of the red LED with time.

The driver circuit can increase the light output of the red LED by (i) increasing the forward drive current $i_{FR}$ of the red LED while maintaining the forward drive current $i_{FB}$ of the blue LED constant or (ii) decreasing the forward drive current $i_{FB}$ of the blue LED while maintaining the forward drive current $i_{FR}$ of the red LED constant. The first control configuration has the benefit that the intensity of the emission product of the device will not drop as much. Moreover it may be desirable to operate the blue LED(s) at their full power output over the life of the system. In such a configuration the red LED(s) can initially be under driven to ensure that there is enough reserve capacity as the device ages to be adjusted to higher output. Over the life of the device, based on the photosensor readings, the current and therefore the light output of the red LEDs would be increased as needed to maintain the target ratio of blue/red light.

The driver circuit 14 can be configured to adjust the drive currents $i_{FB}$, $i_{FR}$ of the blue and red LEDs in response to the emission intensity of the blue and red LEDs $I_B$, $I_R$. Although the device can be controlled in response to the magnitude of the blue and red emission intensities it is found that adequate control can be achieved using the ratio of the intensities $I_B$:$I_R$ or a difference between the intensities $I_B$–$I_R$. Such a control arrangement can reduce the complexity of driver circuit 14.

In accordance with the invention a single photosensor 22 is used to measure both the intensities $I_B$, $I_R$ of blue and red light in the emission product 40. The light emission intensity $I_B$ from the blue LED(s) can be measured by the controller periodically interrupting operation of (switching off) the red LED 18 for a selected time period during which time period the photosensor 22 will measure the intensity of light emitted by the blue LED 16 only. Similarly the light emission intensity $I_R$ for the red LED 18 can be measured by the controller interrupting operation of (switching off) the blue LED for a time period during which output of the photosensor corresponds to the intensity of light emitted by the red LED. To avoid flickering of light from the device each LED is preferably interrupted for a time period of 30 ms or shorter. Alternatively the intensities $I_B$, $I_R$ can be determined by reducing the output intensity from one LED for a selected time period and measuring the emission intensity during the time period. Values related to the intensities $I_B$, $I_R$ can then be determined by comparing measured readings with and without the LED operated at reduced intensity. The purpose of interrupting, or at least changing the light output on one LED, is to isolate one LED light source relative to the other and measure the relative overall light output of the one color LED light source using the broad band photosensor. Such an arrangement eliminates the need for a separate photosensor to measure each component of light and thereby eliminates problems associated with differential ageing of photosensors. Since the color of light produced by each LED is known the absolute or relative brightness of light output by the LEDs can be readily determined. It is assumed that whilst relative aging of the LEDs will result in a relative change in light output of the LEDs for a given drive current, the peak wavelength (color) of the light for each LED remains relatively constant.

It is possible to do similar color readings with color filtered photosensors. For LED-based applications it can be assumed the LED light color is known and therefore the color filtered photosensors can be configured to measure a "relative" amount of power rather than attempt a full colorimetric reading. In this approach a red filter would be used over a first photosensor for measuring light from the red LED(s) and a blue filter used over a second photosensor for measuring light from the blue LED(s). An advantage of this system is that measurements can be taken continuously without a need to interrupt or reduce light output from one or both LEDs. To reduce the effect of differential ageing of the photosensors it is preferred to use an array of photsensors on a single chip (e.g. CCD or CMOS array) and provide a color filter over the top of selected photosensor locations.

Preferably the light emitting system is configured to control the color of light emitted by the system within approximately two MacAdam ellipses of a target color. As is known MacAdam ellipses refer to the region on a chromaticity diagram which contains all colors which are indistinguishable, to an average human eye, from the color at the center of the ellipse. For a white light system this will generally require color control to within two MacAdam ellipses of the black body radiation (Plankian) curve of the chromaticity diagram. It is estimated that to achieve color control within two MacAdam ellipses requires an overall system accuracy (i.e. photosensing accuracy and LED drive control) of 0.66%. For example for a photosensor such as a transistor operated with a 5V (DC) reference voltage would require a sensitivity of ±10 mV. For a PWM current driver the pulse period is preferably less than 20 ms (i.e. >50 Hz) to avoid a perceptible flickering of the emission product. For a PWM drive of period 20 ms would require a 0.1 ms pulse-width control to achieve control within two MacAdam ellipses. Although in the example illustrated in FIG. 2 the LED drivers 26, 28 are PWM drivers, other drivers can be used including a controllable voltage or current source. For a 700 mA current source a relative control of 4.6 mA would be required for controlling the color of emission product of the system within two MacAdam ellipses. Whilst such control is practicable it may be too expensive compared with a PWM driver arrangement.

As described the system is preferably configured to control the "relative" light output of two or more LEDs rather than to control absolute light output which can be more complex. To achieve the required control accuracy (i.e. relative control of around 0.66%) it is preferred to drive each LED from a common power source with PWM used to proportion the amount of power going to each color LED. In this way even if there is a drift in the supply voltage and/or current this will not affect the "relative" drive power to the LEDs which is what determines the color of light emitted by the system.

Moreover since the power supply may shift over time it is preferable that all components in the photosensor use a common power supply. For example where the output voltage of the photosensor is compared with a reference voltage it is preferable that the reference voltage and operating voltage for the photosensor are derived from a common source. In such an arrangement the photosensor measurement becomes a "relative" measurement, rather than an absolute voltage measurement. This can make the system less sensitive to variations in supply voltage and changes in components' performance over time. Such a photosensing arrangement is suited to photosensors that modify a voltage in response to incident light intensity such as a phototransistor, photodiode or photoresistor rather than a photosensor that generates an electrical current in response to incident light such as a photocell.

As indicated by dashed lines in FIG. 2 it is preferred to incorporate the control system (i.e. controller 24) with the power supply electronics, preferably a switching power supply such as a PWM supply. This is because many switching power supplies for LEDs already have a current sensing circuit, a microprocessor and individual driver controls for different LED drive currents. Therefore the only additional electronics needed for the color control functionality may be an additional input 44 for the signal from the photosensor. With such an input, firmware on the microprocessor can be used to modulate the LED output, read the photosensor and, using the control electronics of the switching power supply, make the color adjustments. It is expected that this type of integrated "smart" power supply will be the most effective and economical way to produce the color control system of the invention.

Although the present invention arose in relation to the control of the color of the emission product to compensate for differential ageing of the LEDs, the control system of the invention further provides a number of features including:

"Smart" dimming—the controller can be configured to maintain the color of the emission product of the system during dimmed operation. Normally during dimming a color shift will occur due to the different relative light output of different LEDs. The system of the invention can correct for this so the color ratio stays the same at all color output levels.

"Preset colors"—it is possible to store multiple target color values and then call up a "preset" value for different colors. In this way an LED-based system can consistently produce preset colors.

Matching system colors—assuming multiple lighting fixtures are used in the same space, it is possible to communicate between LED fixtures and systems and use the same ratios to coordinate the colors between lighting fixtures, in this way insuring light to light color consistency.

Light sensor/pulsing communication—since each LED-based device has a photosensor and the system has the ability to pulse the LEDs on and off, the system can be configured to communicate serially with other lighting systems using the same sensing electronics system. In this way it is envisioned that lighting systems could network via the light pulsing of data and coordinate color and control.

It is also envisaged that the controller can take account of ambient light intensity in the control of the color of light emitted by the system. Conveniently the photosensor inside the device can be used to measure the ambient light intensity by interrupting operation of both the blue and red LEDs for a selected time period. The ambient light reading can also be used for other purposes such as detecting daylight, motion detection for security or safety applications or calibration with other lighting systems. Since the LED light readings from the photosensor are "additive" to the ambient light, the ambient light reading can be used to subtract out the ambient light to get a more accurate reading for the light emission from the LEDs only. It will be appreciated that the concept of interrupting operation of the LEDs to measure ambient light intensity can be applied to other lighting systems that incorporate a photosensor.

It will be appreciated that light emitting systems and devices in accordance with the invention are not limited to the exemplary embodiments described and that variations can be made within the scope of the invention. For example whilst the light emitting device has been described as comprising two LEDs that generate light of different colors the invention can be applied to devices comprising three or more different color LEDs such as a device based on red, green and blue LEDs. Moreover, as well as controlling the light emission from the LEDs in response to the measured intensities, it is further contemplated that they can they can be controlled additionally in response to the operating temperature T of the blue and red LEDs. The operating temperature of the LEDs can be measured using a thermistor incorporated in the device. Typically the LEDs will be mounted to a thermally conducting substrate and the temperature of the LEDs can be measured by measuring the temperature of the substrate T which will be approximately the same as the operating temperature of the LEDs.

What is claimed is:

1. A light emitting system comprising:

a light emitting device and a controller for operating the device, wherein the light emitting device comprises:

a first LED (light emitting diode) operable to emit light of a first color;

a second LED operable to emit light of a second color, wherein an emission product of the light emitting device comprises a combination of light emitted by the first LED and the second LED; and a single photosensor that is positioned in the light emitting system relative to the first LED and the second LED based at least in part upon one or more characteristics of the first LED and the second LED and is to measure intensities of the first color and the second color light components in the emission product; and the controller operable to control light emission from the first LED and the second LED by reducing changes in a ratio of a first current to the first LED to the second current to the second LED in response to at least a photosensor measurement result of the intensities, wherein the controller is operable to interrupt light emission from one LED for a time period and during the time period to measure the intensities of a non-interrupted LED light being emitted by the light emitting system.

2. The light emitting system of claim 1, wherein the controller is operable to interrupt light emission from one LED for the time period and during the time period to measure the light intensity of light being emitted by the other LED.

3. The light emitting system of claim 1, wherein the controller is operable to reduce light emission from one LED for the time period and during the time period to measure the light intensity of light being emitted by the other LED.

4. The light emitting system of claim 1, wherein the time period is less than about 30 ms.

5. The light emitting system of claim 1, wherein the controller is operable to maintain a substantially constant ratio of the light of the first color to the light of the second color light in the emission product.

6. The light emitting system of claim 5, wherein the controller is operable to maintain the emission product within approximately two MacAdam ellipses of a target emission product color.

7. The light emitting system of claim 1, wherein the controller controls light emission from the LEDs selected from the group consisting of: controlling a drive current to the LEDs, controlling a drive voltage to the LEDs and operating the LEDs using a pulse width modulated drive signal and controlling a duty cycle of the drive signal.

8. The light emitting system of claim 1, wherein the photosensor is selected from the group consisting of a photodiode, a photo resistor, a photo transistor and a photocell.

9. The light emitting system of claim 1, wherein the first LED is operable to emit blue light having a peak wavelength in a wavelength range 440 nm to 480 nm.

10. The light emitting system of claim 1, wherein the second LED is operable to emit red light of wavelength having a peak wavelength in a wavelength range 610 nm to 670 nm.

11. The light emitting system of claim 10, wherein the at least one phosphor material is operable to emit light having a dominant wavelength in a range 500 nm to 600 nm.

12. The light emitting system of claim 1, and further comprising at least one phosphor material that is operable to absorb at least a portion of light emitted by the first LED and in response to emit light of a different wavelength range.

13. The light emitting system of claim 1, wherein the single photosensor is positioned in the light emitting system by changing relative placement of the first LED and the second LED to the single photosensor.

14. The light emitting system of claim 1, wherein the one or more characteristics of the first LED and the second LED comprise a first range of sensor readings for the first LED and a second range of sensor readings for the second LED.

15. The light emitting system of claim 1, wherein the one or more characteristics of the first LED and the second LED comprise a first color of light emitted by the first LED and a second color of light emitted by the second LED.

16. The light emitting system of claim 1, wherein the controller that is operable to control the emission by reducing changes in the ratio of the first current to the second current is further operable to minimize the changes in the ratio.

17. The light emitting system of claim 1, wherein the controller that is operable to control the emission by reducing changes in the ratio of the first current to the second current is further operable to increase the first current to the first LED while reducing the changes in the ratio.

18. The light emitting system of claim 1, wherein the single photosensor is further operable to measure ambient light to calibrate the light emission of the light emitting system.

19. The light emitting system of claim 1, further comprising a common power supply to both the first LED and the second LED.

20. The light emitting system of claim 1, wherein the controller is configured to control a relative light output of the light emitting system, rather than controlling an absolute output of the first LED or the second LED.

* * * * *